US006496157B1

(12) United States Patent
Mottier

(10) Patent No.: US 6,496,157 B1
(45) Date of Patent: Dec. 17, 2002

(54) RECONFIGURABLE ANTENNA DEVICE FOR A TELECOMMUNICATION STATION

(75) Inventor: David Mottier, Rennes (FR)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/863,470

(22) Filed: May 24, 2001

(30) Foreign Application Priority Data

Jun. 20, 2000 (FR) ..... 00 07889

(51) Int. Cl.[7] ..... H01Q 21/00

(52) U.S. Cl. ..... 343/853; 343/844; 342/373; 342/375

(58) Field of Search ..... 343/844, 853; 342/372, 373, 374, 375; 455/562

(56) References Cited

U.S. PATENT DOCUMENTS 5,726,662 A 3/1998 Hopwood ..... 342/372
5,936,591 A * 8/1999 Yamasa et al. ..... 342/373
5,936,592 A * 8/1999 Ramanujam et al. ..... 342/373
6,252,562 B1 * 6/2001 Diez ..... 342/375
6,347,234 B1 * 2/2002 Scherzer ..... 455/562

FOREIGN PATENT DOCUMENTS

EP 0 437 372 7/1991

* cited by examiner

*Primary Examiner*—Tan Ho
(74) *Attorney, Agent, or Firm*—Oblon, Spivak, McClelland, Maier & Neustadt, P.C.

(57) ABSTRACT

The invention in general terms relates to an antenna device for a telecommunication station, able to transmit or receive a signal and comprising a plurality of radiating elements disposed in a periodic arrangement having at least one spatial periodicity. The device has antenna configuration means adapted to cause the value of the said spatial periodicity to vary according to the transmission conditions. The antenna device can in particular be configured so as to operate according to a beam shaping mode or according to a spatial diversity mode.

18 Claims, 6 Drawing Sheets

RECONFIGURABLE ANTENNA DEVICE FOR A TELECOMMUNICATION STATION

BACKGROUND OF THE INVENTION

1. Field of the Invention

The present invention concerns in general terms an antenna device, notably for a telecommunication station, and more particularly an antenna device comprising a periodic arrangement of radiating elements.

2. Description of Related Art

Recent developments in antenna systems for mobile telephony have revealed an increasing interest in so-called "intelligent" antennae. Such an antenna consists of a array of elementary antennae with a pitch less than or equal to the half-wavelength of the transmission frequency, which can be used both for transmission and for reception. Depending on circumstances, the input or output signals of the elementary antennae are offset in phase and weighted so as to obtain the required radiation diagram. Thus, for example, an intelligent antenna equipping a base station can form a beam pointing in the direction of a mobile terminal and/or eliminate interference coming from a given direction.

There are also known mobile telephony systems referred to as spatial diversity systems for combating the fading in the signal due to propagation on multiple paths. These systems use a plurality of antennae, spaced apart typically by four to ten times the wavelength of the transmission frequency and taking advantage of the fact that the signals received by sufficiently distant antennae are decorrelated. Thus signals which have propagated on several paths as far as a first antenna (the first diversity branch) giving rise to destructive interference can on the other hand give rise to constructive interference at another antenna (the second diversity branch). The reception diversity is then exploited, for example, in that, at a given moment, the diversity branch giving the best signal to noise ratio (Selective Combining) is selected or the different branches are summed after they have been weighted by a gain equal to the conjugate complex of the complex attenuation coefficient on the branch under consideration (Maximal Ratio Combining).

The antenna arrays as mentioned above do not deal well with spatial diversity functioning since the signals received by two consecutive antennae are generally not sufficiently decorrelated. It can then be thought of increasing the pitch of the array, as proposed in the article by H. Yoshinaga et al. entitled "Performance of adaptive array antenna with widely spaced antenna elements" which appeared in the Proceedings of VTC '99, pages 72–76. However, increasing the pitch inevitably introduces array lobes in the radiation diagram, which impairs the spatial selectivity of the system.

It is also known that mobile telecommunications systems use different transmission frequencies, typically 900 MHz and 1800 MHz for GSM systems, 2 GHz for future UMTS systems and even higher frequencies, probably in the 20–30 GHz band, for satellite mobile telephony. The antenna arrays being, as has been seen, designed for a given frequency, the intelligent antennae used for one generation in mobile telephony will not operate or will operate badly with the following generation. The operator must then, with each generation, bear the considerable cost of new equipment.

SUMMARY OF THE INVENTION

The aim of the invention is to propose an intelligent antenna which does not have the aforementioned drawbacks, namely allowing both the shaping of a beam and diversity reception and being able to adapt easily to a new mobile telephony.

To this end, the antenna device according to the invention comprises a plurality of radiating elements disposed in a periodic arrangement having at least one spatial periodicity, characterised in that it has antenna configuration means adapted to vary the value of the said spatial periodicity according to the transmission conditions.

According to a first characteristic of the invention, the antenna device comprises a beam shaper adapted to form a beam in at least a first direction using input signals to and/or output signals from radiating elements.

According to a second characteristic of the invention, the antenna device comprises at least one beam shaper adapted to reject an interfering signal in at least a second direction using the output signals from the radiating elements.

According to a third characteristic of the invention, the antenna device comprises a receiver or transmitter adapted to receive: or transmit in spatial diversity.

Another embodiment of the invention comprises a mixed system able to function either as a beam shaper or as a receiver in spatial diversity, the configuration means fixing the pitch of the array at a value less than or equal to a half-wavelength when the mixed system is functioning as a beam shaper and at a value substantially greater than the wavelength when it is functioning as a spatial diversity receiver.

Advantageously, the configuration means are adapted to place the antenna in an intermediate configuration without antenna processing during the phase of variation in the spatial periodicity.

Advantageously again, the configuration means comprise hysteresis or timing means able to eliminate unwanted changes in the said spatial periodicity.

According to a first variant of the invention, the configuration means comprise at least one rail in which the supports for the radiating elements can slide.

According to a second variant of the invention the radiating elements consist of a plurality of elementary antennae. The configuration means comprise a plurality of units adapted to weight and sum a set of output signals from adjacent elementary antennae, a switch directing certain output signals from the said units to the inputs of at least one beam shaper, the spatial periodicity of the radiating elements being modified by selecting the output signals from elementary antennae and the output signals from these units.

Advantageously, the transmission conditions are one or more characteristics of the transmission amongst the bit error rate, the packet error rate, the ratio between the power of the signal to noise plus interference, the quality of service and the power consumed by the transmitter responsible for the transmission.

Finally, the antenna device according to the invention can be integrated into a mobile terminal or a base station.

BRIEF DESCRIPTION OF THE DRAWINGS

The characteristics of the invention mentioned above, as well as others, will emerge more clearly from a reading of the following description of example embodiments, the said description being given in relation to the accompanying drawings, amongst which.

DETAILED DESCRIPTION OF THE PREFERRED EMBODIMENTS

Figure 1:
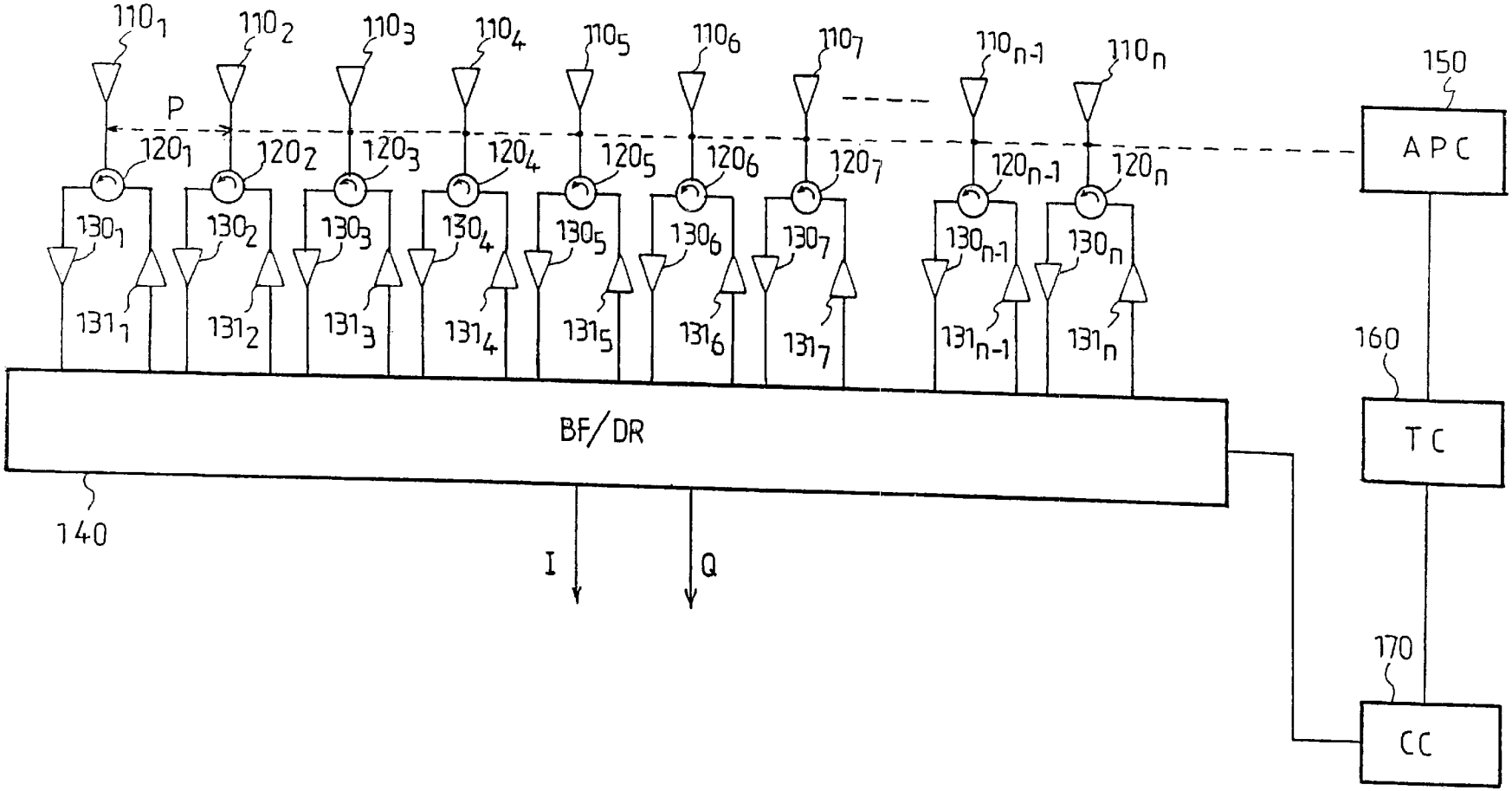
FIG. 1 depicts an antenna device according to a first embodiment of the invention.

The antenna device according to the invention comprises in general terms an array of antennae whose pitch is variable according to the transmission conditions. Array of antennae means any arrangement of antennae having at least one spatial periodicity. In other words, the array can be linear, circular, of matrix form or hexagonal without the generality of the invention being affected thereby.

Transmission conditions means any characteristic of the transmission or any factor able to affect it. This will in the first place be the frequency of the carrier used. Next it will be the type of propagation: propagation with high or low spatial diversity, propagation with multiple paths with direct-line or specular component (Rice model) or without such component (Rayleigh model). It will also be the presence or absence of interfering sources. It will again be other factors influencing or characterising the error rate (bit or packet) such as for example the ratio of the power of the signal to noise plus interference (SIR) or the quality of service (QoS).

The transmission conditions set out above non-limitatively can mean that one method of use of the network will be preferred, according to a spatial diversity reception (or transmission) mode or a beam shaping mode. For example, if the antenna array of a base station receives a signal from a mobile terminal which has undergone a Rayleigh scattering, there may be an advantage therein in opting for a spatial diversity configuration. On the other hand, if interfering sources are present or if the system is to function in spatial division multiple access (SDMA), it will be appropriate to opt for the beam shaping configuration. The choice of the configuration depends on the performance level of the transmission in terms of bit or packet error rate, ratio of the power of the signal to noise plus interference (SIR), quality of service (QoS) or power consumed by the transmitter. In some cases, this performance level is predictable: for example, in the case of a propagation of the signal without scattering of the Rice type and in the absence of interfering signals, there will be an advantage in opting for a beam shaping configuration, both on transmission and on reception, in order to minimise the power consumed by the transmitter. In yet other cases, the choice of the configuration will be based on the results of simulation or statistics of use. In the absence of such criteria, the choice will depend on real-time measurements made for one or both configurations.

If the system opts for a beam shaping configuration, the pitch of the array will be fixed at a value less than or equal to the half-wavelength of the carrier frequency used for transmission whilst if the system opts for spatial diversity configuration the pitch of the array will be fixed at a value greater than the wavelength.

The antenna device according to the invention functions of course both in reception and in transmission. This will be understood easily when a beam is directed towards a transmitting or receiving station but applies just as validly in the context of spatial diversity. Thus, when the environment of a base station is not propitious to propagation on multiple paths, the antenna array can be configured so as to introduce spatial diversity on transmission by increasing its pitch.

FIG. 1 depicts schematically a first embodiment of the invention. The array 110, consisting of antennae $\mathbf{110}_l \ldots \mathbf{110}_n$, is here, by way of example, a linear array, but an array of any other type could have been used. The antenna device has been illustrated in reception mode. The output signals from the antennae $\mathbf{110}_i$ are transmitted by duplexers $\mathbf{120}_i$ to the inputs of low noise amplifiers (LNAs) $\mathbf{130}_i$. After amplification, the signals are supplied to an antenna processing module 140, which can be either a beam shaper BF, or a spatial diversity receiver DR if only one or other configuration is enabled, or a mixed system enabling both, as will be seen later. In transmission mode, the signals issuing from the module 140 are directed to the power amplifiers $\mathbf{131}_i$ and then to the duplexers $\mathbf{120}_i$ before being sent to the antennae $\mathbf{110}_i$. The device also comprises a module 160 analysing the transmission conditions and choosing, where applicable, between a beam shaping configuration and a spatial diversity configuration. The decision algorithm will advantageously have hysteresis or will comply with a timeout after switching in order to prevent unwanted changes in configuration. The module 160 supplies to the calculation module 170 the parameters for calculating the phase shifts and the weighting coefficients necessary for the beam shaper as well as the complex fading gain coefficients necessary for the diversity receiver. Although the system depicted has only one beam shaper, it goes without saying, however, that several beam shapers working in parallel to form beams in different directions can be envisaged. In this case, the calculation module supplies the phase shifts and weighting coefficients to all the shapers. Finally, the module 160 supplies to the antenna position controller the value of the array pitch to be adopted. The module 160 transmits the signals necessary to the antenna movement device or devices so that the antennae are positioned according to the required pitch.

The output signals from the beam shaper are for example directed to an equalisation device or to a channel decoder. More generally, the antenna processing can be interlaced with other processing of the base band signal. Thus equalisation can also be effected branch by branch (diversity configuration) or channel by channel (beam shaping configuration), prior to the antenna processing.

Figure 2:
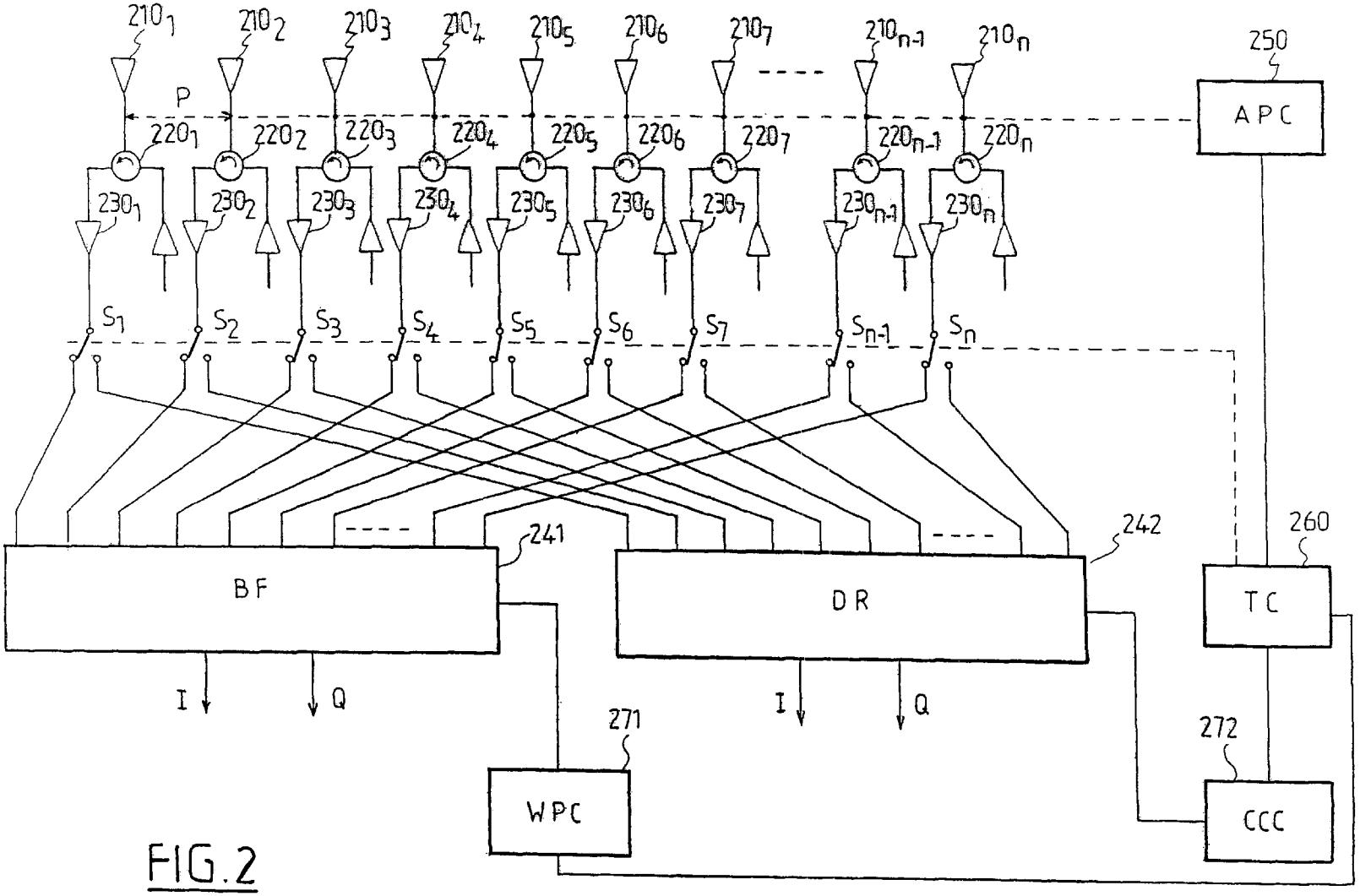
FIG. 2 depicts an antenna device according to a second embodiment of the invention.

FIG. 2 depicts schematically a second embodiment of the invention. The device comprises an array 210 consisting of antennae $\mathbf{210}_l \ldots \mathbf{210}_n$, coupled through duplexers $\mathbf{220}_l \ldots \mathbf{220}_n$ to a low-noise amplification stage 230. The amplified signals are then directed by means of switches $S_1\ S_2 \ldots S_n$ to one or more beam shapers 241 or to a receiver working in spatial diversity 242. The state of the switches is controlled by a module 260 analysing the transmission conditions. This module also supplies to the antenna positioning controller the value of the array pitch to be adopted. It also transmits to a first calculation module 271 a set of parameters for determining the phase shifts and the weighting coefficients required for the beam shaping. These parameters are for example the arrival direction of the signal to be received, the arrival direction of an interfering signal, the lobe width of the beam, the root mean square error or the instantaneous error between the signal received and a reference signal. It supplies to a second calculation module 272 the parameters necessary to the estimation of the complex fading gains to be applied to the signals from the different antennae.

The change from one configuration mode to the other takes place by switching the switches and modifying the pitch of the array. For beam shaping the pitch of the array is fixed at a value less than or equal to the half-wavelength of the carrier frequency used whilst for spatial diversity reception a pitch substantially greater than the wavelength, typically 4 to 10 times its value, will be adopted. Since the modification of the pitch is not instantaneous, it is important to reduce the transience during switching. For this purpose, the switching is prepared as follows. Assume the case of a change from beam shaping configuration to a spatial diversity configuration or to another beam configuration with a different array pitch. The phase shifts are switched, or more advantageously progressively brought to the zero value and the weighting coefficient to value 1, giving rise to a broadening and disaligning of the beam (or beams). Thus, for example, if the array is of the circular type, there will be a change from a sectorial diagram to an omnidirectional diagram. If the array covers only one sector, likewise there will be a change from a narrow lobe diagram to a sectorial diagram. When the antenna processing (here the beam shaping) is thus eliminated, the device is little sensitive to a variation in the pitch of the array and the modification of the pitch can occur without any risk of generating aberrant values.

If the arrival configuration is also a beam shaping, the device causes the phase shifts and the weighting coefficients to change to their new values calculated by the module 271.

If the arrival configuration is spatial diversity, the device switches the switches $S_i$ and applies the spatial diversity processing.

Figure 3:
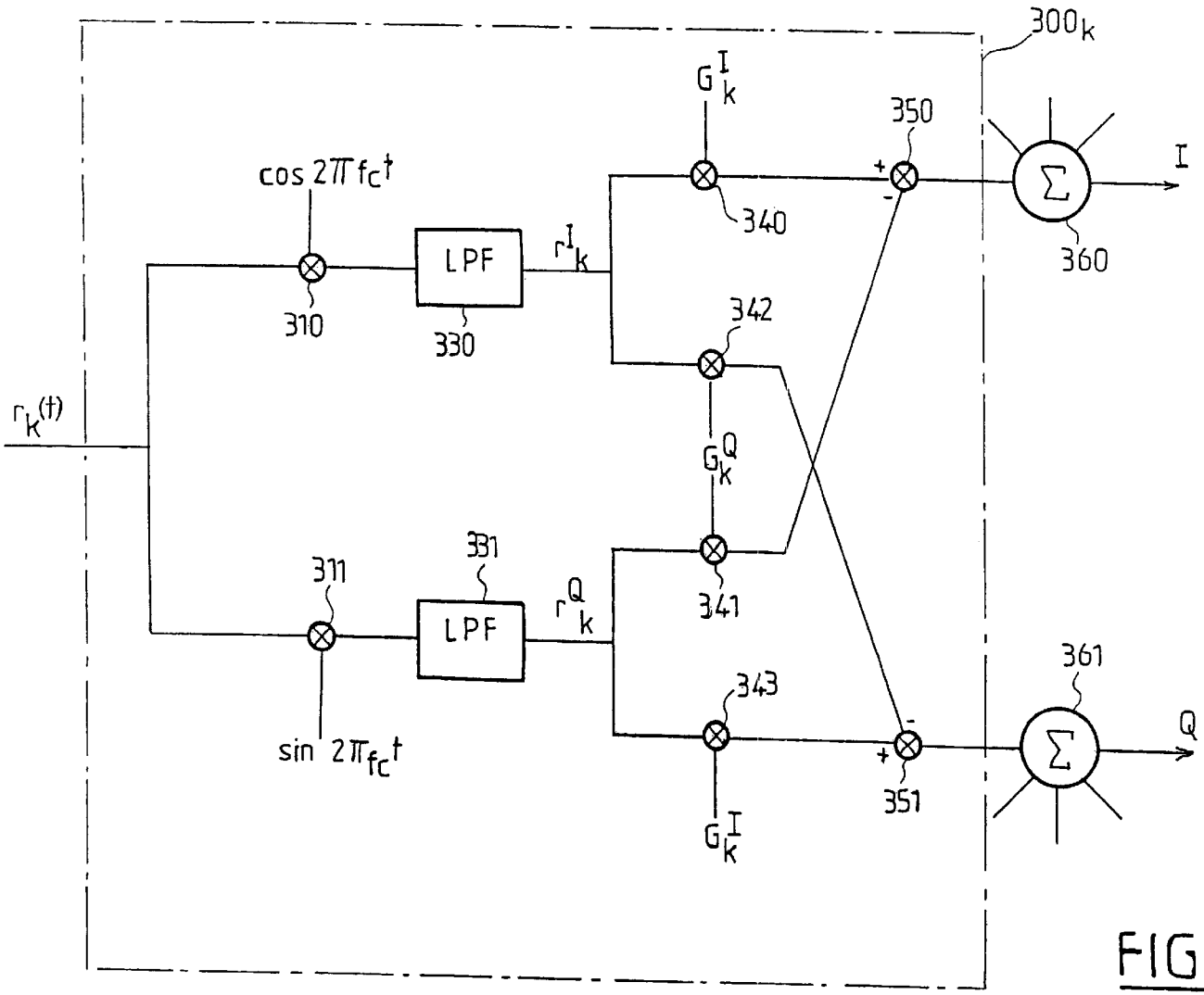
FIG. 3 depicts a mixed system useful to the first embodiment of the invention.

FIG. 3 depicts a mixed system which can be used in the design of the antenna device illustrated in FIG. 1. The unit 140 in FIG. 1 comprises a plurality of modules $\mathbf{300}_k$ and a pair of adders 360, 361. The structure of the module $\mathbf{300}_k$ results from the finding that some operations performed for the beam shaping and for diversity reception are similar. The signal $r_k(t)$ output from the LNA $^{130}{}_k$ first of all undergoes a quadrature demodulation by means of the multipliers 310 and 311 and then a low-pass filtering by means of the filters 330 and 331 which eliminate the components $2f_c$. The complex signal $r_k$ of components $r_k^I$ and $r_k^Q$ is then multiplied by a complex value $G_k$ of components $G_k^I$ and $G_k^Q$ in order to obtain a complex product of components $r_k^{I*}G_k^I - r_k^{Q*}G_k^Q$ and $r_k^{I*}G_k^Q + r_k^{Q*}G_k^I$. The complex products coming from the modules $\mathbf{300}_k$ are summed by the adders 360 and 361 and the resulting sum is directed to the outputs I and Q of the module 140. If the beam shaping configuration is selected, the complex value $G_k$ is chosen equal to $\rho_k \exp(-j\Phi_k)$ where $\rho_k$ is the weighting coefficient and $\Phi_k$ the phase shift coefficient applicable to the antenna k. The modules $^{300}{}_k$ associated with the adders 360 and 361 then operate like a conventional base band beam shaper. On the other hand, if diversity configuration is adopted, the complex value $G_k$ is chosen equal to $g^*{}_k$ where $g_k$ is the complex fading gain associated with the antenna k. The combination of the modules $\mathbf{300}_k$ and adders 360 and 361 then function like a diversity receiver of the MRC (Maximum Ratio Combining) type. Naturally, other types of diversity processing can be envisaged: thus it is possible to choose $G_k = G^*\delta(k-k_0)$ where $k_0$ is the index of the branch giving the best signal to noise ratio (Selective Combining) or $G_k = G\ \forall k$ where G is a given gain.

The change from one configuration to the other and in more general terms the change in the array pitch is prepared by fixing the coefficients $G_k$ at the value 1, or more advantageously by, in an initial phase, progressively bringing the coefficients $G_k$ to the value 1 in order to avoid any transient phenomenon. The pitch of the array is then modified in an intermediate phase. After the change in pitch, the coefficients $G_k$ are fixed at their new set values, or more advantageously progressively brought, in a final phase, to their new set values in order to avoid any transient phenomenon. Where the module $\mathbf{300}_k$ is produced digitally, for example by means of analogue to digital converters at the output of the filters 330 and 331, the initial phase and final phase can obviously be instantaneous. However, if it is wished to avoid any transient effect downstream of the module $\mathbf{300}_k$, smoothing will advantageously be used in the initial phase and final phase.

Figure 4:
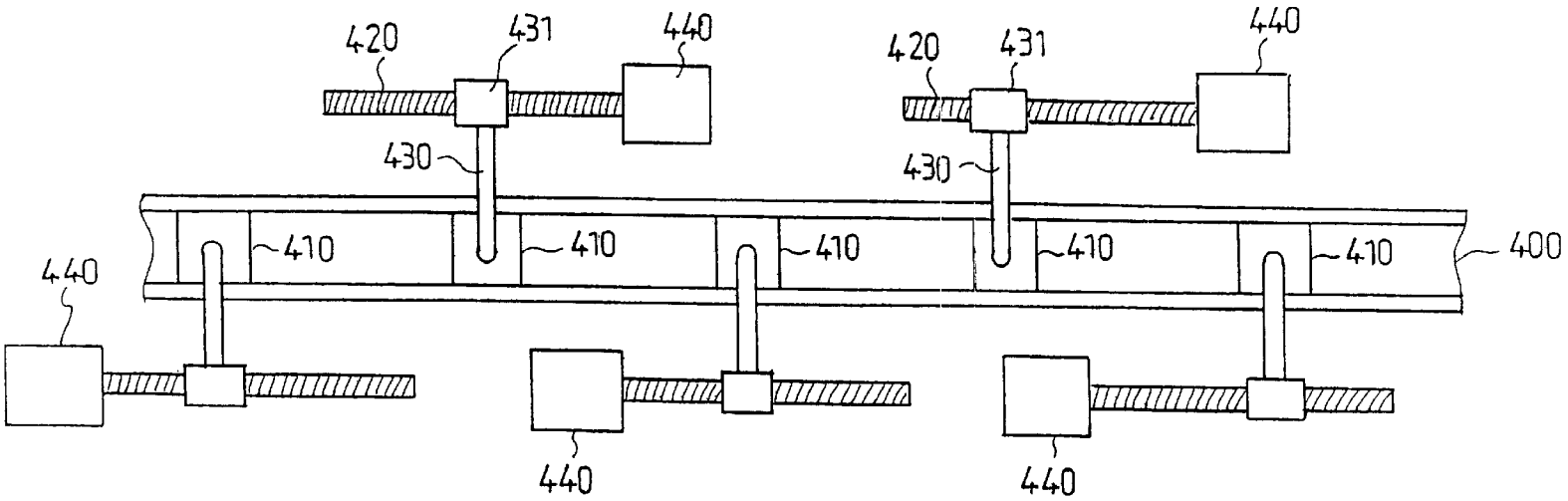
FIG. 4 depicts a first antenna movement device useful to the implementation of the invention.

FIG. 4 depicts a first device for mechanically moving the antennae in an array. The device comprises a rail 400 having a U shaped profile whose edges are curved towards the centre of the rail and in which antenna supports 410 can move. Easy sliding is provided by rollers (not shown) fitted to the bottom and the internal walls of the rail or any other equivalent means. To each antenna support there is fixed a lug 430 having at its free end a threaded passage 431. Motors 440 rotate worms 420 rotating in the threaded passages 431. Thus, by controlling the motors 440 in an appropriate manner, the antenna supports can be moved in translation so as to comply with a given spacing.

Figure 5:
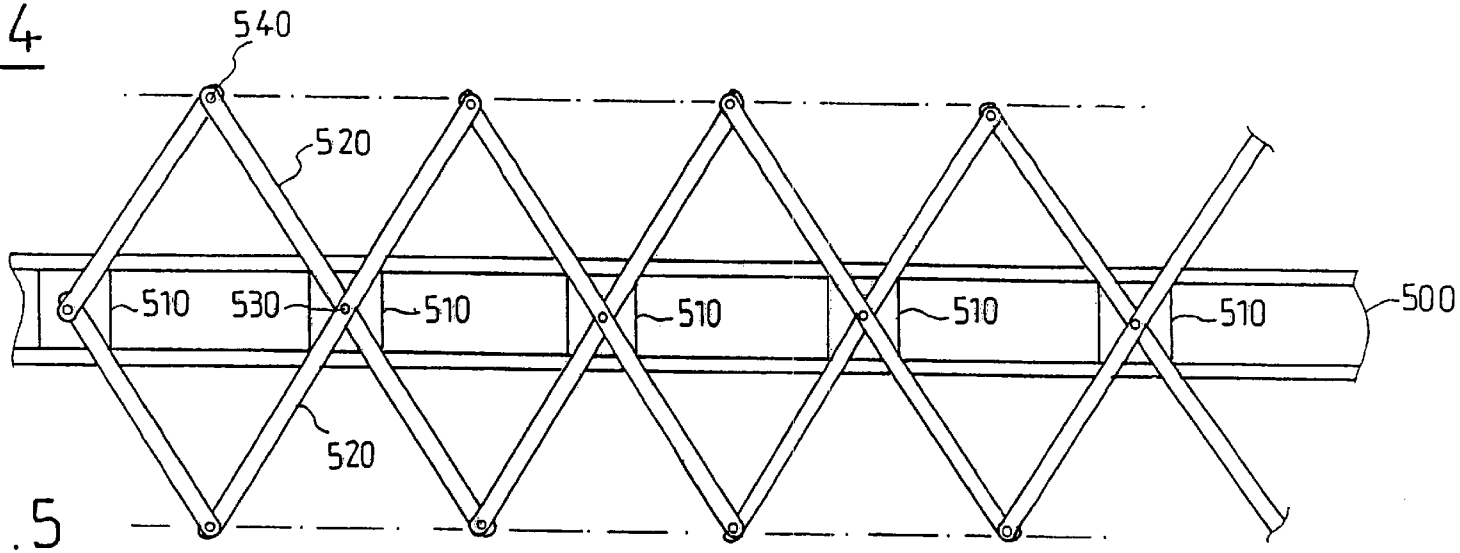
FIG. 5 depicts a second antenna movement device useful to the implementation of the invention.

FIG. 5 depicts a second mechanical device for moving the antennae in an array. The antenna supports 510 can, there too, slide inside a rail 500. For each support two blades 520 are provided, able to pivot about a shaft 530. The blades of a support are connected at their ends by shafts 540 to the ends of the blades of the adjacent supports. All the blades therefore form a trellis which can be compressed or unfolded as required whilst guaranteeing identical spacing between the different antennae. The compression or expansion of the trellis is provided by a worm driven by a motor and a threaded passage fixed to the antenna support at a movable end of the trellis. The second end can be fixed or also movable. In the latter case, the two movable ends will advantageously be both equipped with the movement device. It is clear that other devices can be envisaged according to the type of array. For example, if the array is of the matrix type, several parallel rails will be employed and the inter-rail separation will be adjusted by means of worm or deformable trellis devices as described in FIGS. 4 and 5. If the array is circular, devices for moving antennae on a rack in the shape of an arc of a circle or by means of a mechanism of the umbrella type can also be envisaged.

Figure 6:
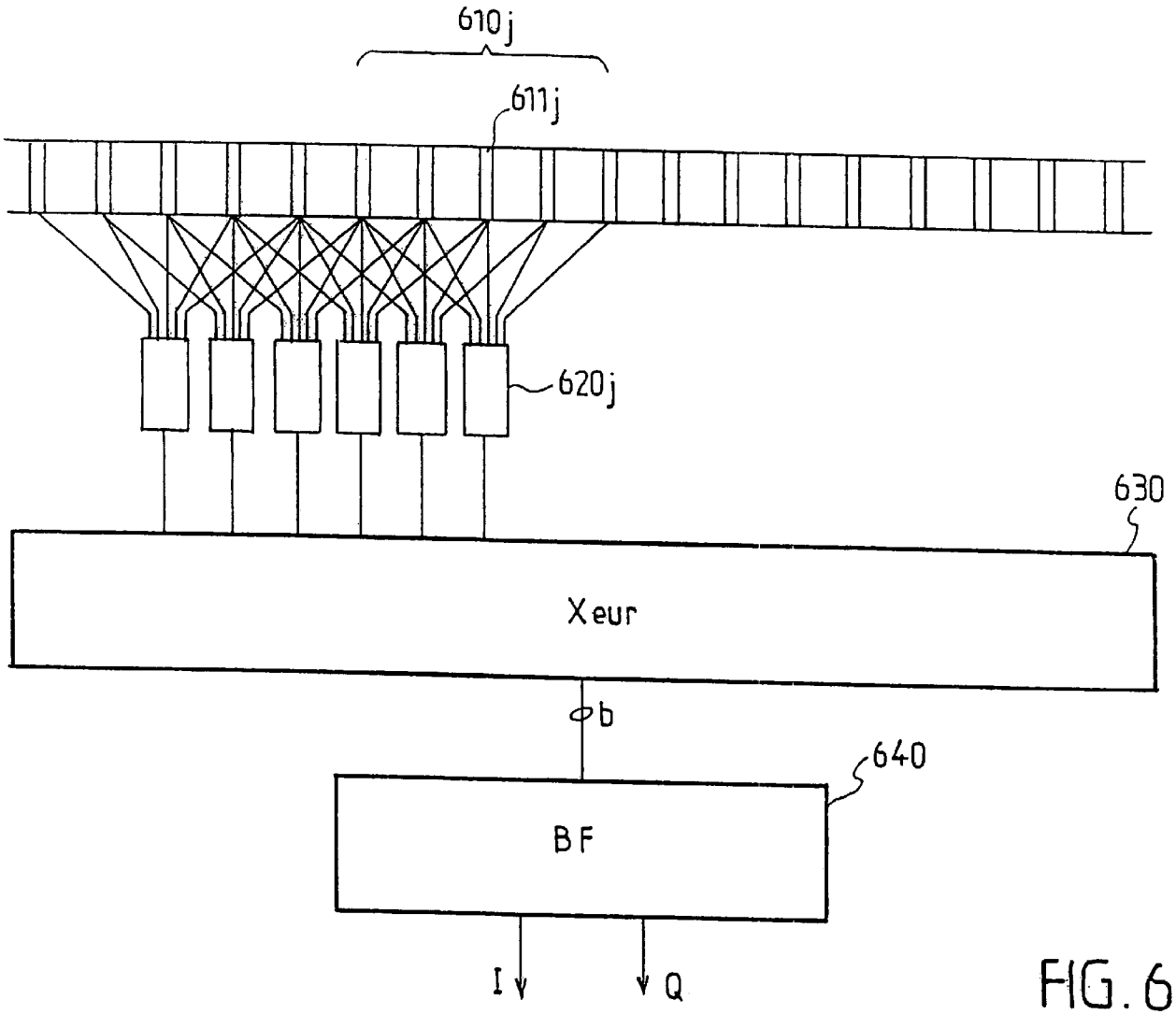
FIG. 6 illustrates an embodiment of the invention using a third antenna movement device.
Figure 7:
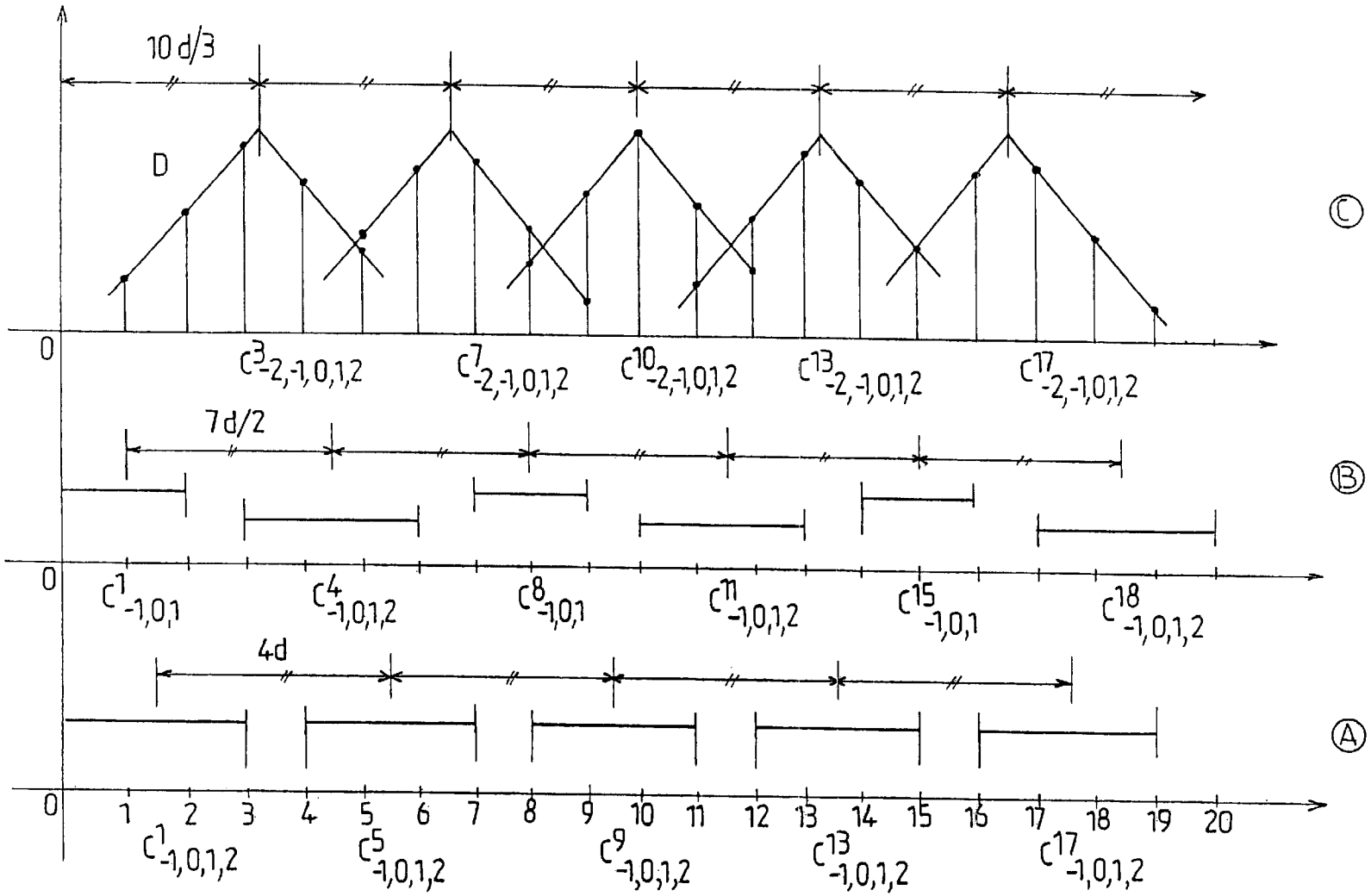
FIG. 7 illustrates the functioning of the embodiment of the invention depicted in FIG. 6.

FIG. 6 illustrates an embodiment of the invention using an electronic device for varying the pitch of the array. This device lends itself well to applications requiring rapid reconfiguration. For reasons of clarity, the duplexers and low-noise amplifiers have not been depicted. The device consists of a large number of elementary antennae $\mathbf{611}_j$, for example slot antennae or antennae of the microstrip type, each elementary antenna $\mathbf{611}_j$ being connected to a set of grouping units $\mathbf{620}_{j-k}, \ldots, \mathbf{620}_{j+k}$. In an equivalent fashion, each grouping unit $\mathbf{620}_j$ receives at its inputs the signals from the elementary antennae $\mathbf{611}_{j-k}, \ldots, \mathbf{611}_{j+k}$. The output of each grouping unit is connected to a switch 630 directing certain outputs of grouping units (in fact the outputs of the active units, as will be seen below) to the inputs of the beam shaper 640 (or even to beam shapers operating in parallel) or to a spatial diversity receiver or to a mixed system as seen above. The role of the grouping circuits is to simulate an array with the required pitch. The functioning of the grouping circuits is explained in FIG. 7. Three examples of array pitch simulation A, B, C are depicted therein. On the X-axis are the serial numbers j of the elementary antennae and on the Y-axis are weighting coefficient values. Example A is a simple case where the elementary antennae are grouped by packets with the same size q. The equivalent array pitch is then q*d, where d is the pitch of the basic array. The output signals of the elementary antennae all undergo the same weighting in the grouping units before being summed therein. Below the X-axis line there have been indicated the active grouping units in the form $C_z^j$ where j is the index of the active unit $\mathbf{620}_j$ and z is a subset of (−k,−k+1, . . . ,0, . . ,k−1,k) of the connections adopted for the weighting, the others being multiplied by a zero coefficient or inhibited. Example B shows the design of an equivalent array with a pitch of the form (2p+1)d/2 where p is an integer. The array is simulated by alternating the packets of p and p+1 elementary antennae. The difference in weighting level between the packets of p and p+1 elements is due to the standardisation according to the number of elementary antennae per packet. Finally, example C illustrates the general case where it is wished to simulate an array with a fractional pitch d*q/p with q, p integers and q>p. The amplitude distribution D is first of all determined, corresponding to the required radiation diagram of an equivalent antenna $\mathbf{610}_j$, for example by means of a reverse Fourier transform. This distribution is repeated at the required periodicity and the weighting coefficients are obtained, like the values of this distribution taken at the points of the basic network. The values are then standardised (not shown) so that the power received per packet is constant. For reasons of simplification, the distribution illustrated is triangular although in practice it will be Gaussian or will correspond to a portion of a cardinal sine. For each equivalent antenna the set of 2k+1 points with the greatest amplitude is adopted for the weighting and this set determines the grouping unit which will be active for this antenna. Although the weighted coefficients illustrated are real, it is clear that in general these coefficients will be complex so as to take into account the phase differences between elementary antennae for a given angle of incidence. In the latter case, however, the functioning in multibeam mode will require replication of the grouping stage for each beam shaper.

Although certain functionalities of the invention have been depicted in an analogue processing form, it is clear that they can be implemented digitally and be executed by dedicated or universal digital processors.

What is claimed is:

1. An antenna device for a telecommunication station, able to transmit or receive a signal, the antenna device comprising:

a plurality of radiating elements physically arranged with respect to each other in accordance with at least one spatial periodicity; and antenna configuration means for causing said spatial periodicity to vary according to transmission conditions.

2. The antenna device of claim 1, further comprising:

at least one beam shaper adapted to form a beam in at least a first direction using input signals to and/or output signals from said radiating elements.

3. The antenna device of claim 1 or 2, further comprising:

at least one beam shaper adapted to reject an interfering signal in at least a second direction using output signals from said radiating elements.

4. The antenna device of claim 2, wherein:

transmission of the signal taking place on a carrier frequency, and said configuration means fixes said spatial periodicity at a value less than or equal to a half-wavelength of said carrier frequency.

5. The antenna device of claim 1, further comprising:

a receiver and a transmitter adapted to receive or transmit in spatial diversity.

6. The antenna device of claim 5, wherein:

the transmission taking place on a carrier frequency, and the configuration means fixes said spatial periodicity at a value greater than a wavelength of said carrier frequency.

7. The antenna device of claims 2 or 4 or 5, further comprising:

a plurality of switches configured to direct antenna input or output signals either to a beam shaper or to a spatial diversity transmitter or receiver, wherein the configuration means fixes said spatial periodicity at a value less than or equal to a half-wavelength of the carrier frequency of the signals when the signals are switched to the beam shaper, and to a value greater than a wavelength if the signals are switched to the spatial diversity transmitter or receiver.

8. The antenna device of claim 1, further comprising:

a mixed system configured to function either as a beam shaper or as a spatial diversity receiver, wherein the configuration means fixes said spatial periodicity at a value less than or equal to a half-wavelength when the mixed system is functioning as a beam shaper, and at a value greater than a wavelength when the mixed system is functioning as a spatial diversity receiver.

9. The antenna device of claim 1, wherein:

the configuration means are configured to put the antenna in an intermediate configuration without antenna processing during a phase of varying said spatial periodicity.

10. The antenna device of claim 1, wherein:

the configuration means includes hysteresis or timeout means for eliminating unwanted changes in said spatial periodicity.

11. The antenna device of claim 1, wherein:

the radiating elements are fixed to supports, and the configuration means include at least one rail in which the supports can slide.

12. The antenna device of claim 11, wherein:

the configuration means includes a plurality of worms engaged in threaded passages fixed to the supports of the radiating elements, and a spacing between the radiating elements varies according to rotation of said worms.

13. The antenna device of claim 11, wherein:

the configuration means includes a deformable trellis having junction points connected to the supports of the radiating elements, and a spacing between radiating elements varies according to compression or expansion of said trellis.

14. The antenna device of claim 1, wherein:

the radiating elements include a plurality of elementary antenna elements.

15. The antenna device of claim 14, wherein a) the configuration means includes:

i) a plurality of units adapted to weight and sum a set of output signals from adjacent elementary antenna elements, and ii) a switch directing certain output signals from said units to inputs of at least one beam shaper, and b) the spatial periodicity of the radiating elements is modified by selecting output signals from the elementary antenna elements and output signals from said units.

16. The antenna device of claim 1, wherein said transmission conditions include one or more of:

the bit error rate, the packet error rate, the ratio of the power of the signal to noise plus interference, the quality of service, and the power consumed by the transmitter responsible for the transmission.

17. A mobile terminal comprising the antenna device of claim 1.

18. A base station comprising the antenna device of claim 1.

* * * * *